US006568641B2

(12) United States Patent
Hoyer et al.

(10) Patent No.: US 6,568,641 B2
(45) Date of Patent: May 27, 2003

(54) ELECTRICALLY OPERATED RAILROAD SWITCH MACHINE

(75) Inventors: Ray Hoyer, St. John, IN (US); Stephen R. Kuhn, Richton Park, IL (US)

(73) Assignee: Meridian Rail Information Systems Corp., Lombard, IL (US)

( * ) Notice: Subject to any disclaimer, the term of this patent is extended or adjusted under 35 U.S.C. 154(b) by 0 days.

(21) Appl. No.: 10/156,927

(22) Filed: May 29, 2002

(65) Prior Publication Data

US 2003/0025044 A1 Feb. 6, 2003

Related U.S. Application Data

(62) Division of application No. 09/585,666, filed on Jun. 1, 2000, now Pat. No. 6,427,950.

(60) Provisional application No. 60/137,804, filed on Jun. 4, 1999.

(51) Int. Cl.[7] ..... B61L 7/00

(52) U.S. Cl. ..... 246/257; 246/407; 246/260; 246/220

(58) Field of Search ..... 246/257, 258, 246/260, 262, 263, 220, 476, 314, 253, 407

(56) References Cited

U.S. PATENT DOCUMENTS

| | | | | |
|---|---|---|---|---|
| 1,789,621 A | | 1/1931 | Eppley | |
| 1,789,894 A | * | 1/1931 | Coleman | 246/253 |
| 1,802,875 A | | 4/1931 | Conley | |
| 2,054,543 A | | 9/1936 | Hoffman et al. | |
| 2,130,444 A | * | 9/1938 | Allen | 246/219 |
| 2,203,913 A | | 6/1940 | Logan, Jr. | |
| 2,575,037 A | | 11/1951 | Andersen | |
| 3,136,509 A | | 6/1964 | Magnus | |
| 3,158,345 A | | 11/1964 | Wilhelm et al. | |
| 3,363,097 A | | 1/1968 | Wilhelm et al. | |
| 3,427,448 A | | 2/1969 | Redelman | |
| 4,213,588 A | | 7/1980 | Bowles | |
| 4,291,854 A | | 9/1981 | Pelt et al. | |
| 4,417,392 A | | 11/1983 | Wyatt | |
| 4,428,552 A | | 1/1984 | Frank et al. | |
| 4,627,331 A | | 12/1986 | Fejes | |
| 4,638,717 A | | 1/1987 | Carr | |
| 4,683,805 A | | 8/1987 | Fejes | |
| 4,970,965 A | | 11/1990 | Burg et al. | |
| 5,052,642 A | | 10/1991 | Peters | |
| 5,192,038 A | | 3/1993 | Ocampo | |
| 5,293,892 A | | 3/1994 | Fourqurean | |
| 5,375,796 A | | 12/1994 | Turner et al. | |
| 5,470,035 A | | 11/1995 | Sargis | |
| 5,504,405 A | | 4/1996 | Hager | |
| 5,531,408 A | | 7/1996 | Wechselberger | |
| 5,669,587 A | | 9/1997 | Van Alstine et al. | |
| 5,775,647 A | | 7/1998 | Wyatt | |
| 6,149,106 A | | 11/2000 | McQuistian | |

FOREIGN PATENT DOCUMENTS

| | | |
|---|---|---|
| DE | 3916696 A1 | 12/1989 |
| DE | 3825182 A1 | 2/1990 |
| FR | 2442750 A1 | 6/1980 |
| FR | 2529002 A2 | 12/1983 |

* cited by examiner

*Primary Examiner*—Mark T. Le
(74) *Attorney, Agent, or Firm*—Barnes & Thornburg

(57) ABSTRACT

A switch machine for moving railroad switch points. The switch machine includes a switch stand adapted to be connected to the railroad switch points. The switch stand includes a rotatable hub which is selectively rotatable to throw the switch points. A rotary actuator includes a rotatable pinion that is coupled to the hub of the switch stand. A hydraulic pump and a valve are in fluid communication with the rotary actuator and selectively control the direction of rotation of the pinion. A first proximity sensor and a second proximity sensor are provided to sense the position of the pinion and hub. When the pinion and hub are rotated to a first position to move the switch points to a first switch point position, the first sensor will deactivate the hydraulic pump. When the pinion and hub rotate the switch points to a second switch point position, the second proximity sensor will deactivate the hydraulic pump.

5 Claims, 4 Drawing Sheets

ELECTRICALLY OPERATED RAILROAD SWITCH MACHINE

RELATED APPLICATIONS

This application is a division of U.S. application Ser. No. 09/585,666, filed Jun. 1, 2000, now Pat. No. 6,427,950, which claims the benefit of U.S. Provisional Application No. 60/137,804, filed Jun. 4, 1999.

BACKGROUND OF THE INVENTION

The present invention is directed to an electrically operated railroad switch machine including a switch stand and an electrically powered operating assembly, and in particular to a switch machine wherein the operating assembly is adapted to be connected to various different types of switch stands.

Railroad switch stands of the type disclosed in U.S. Pat. Nos. 2,054,543 and 2,575,037 are manually operated. Switch stands are adapted to be attached to a connecting rod which in turn is connected to first and second switch points of a railroad switch. The switch stand is adapted to move the connecting rod back and forth in a generally linear direction to thereby conjointly move the first and second switch points between a first position and a second position. The switch stands include a hand lever that is manually rotated through an angle of approximately 180° in a first rotational direction to thereby correspondingly move the switch points from the first position to the second position. The switch points are returned to their original first position from the second position by manually rotating the hand lever in a second rotational direction opposite to the first rotational direction.

SUMMARY OF THE INVENTION

A switch machine for moving railroad switch points. The switch machine includes a switch stand having a rotatable hub that is operatively connected to a pivot shaft. The pivot shaft is adapted to be connected to the railroad switch points such that rotation of the hub results in the throwing of the railroad switch points between a first switch point position and a second switch point position. An operating apparatus is coupled to the hub of the switch stand for providing automatic operation of the switch stand. The operating apparatus includes a rotary actuator having a rotatable pinion connected to a rotatable shaft that are selectively rotatable between a first position and a second position. A coupling member is attached to the shaft of the rotary actuator for conjoint rotation with the pinion and the shaft. The coupling member is adapted to rotationally couple the pinion and the shaft to the hub of the switch stand. A hydraulic pump is in fluid communication with the rotary actuator for providing selective rotational movement of the pinion. A valve is in fluid communication between the hydraulic pump and the rotary actuator for selectively controlling the direction of rotation of the pinion and the shaft. The hydraulic pump is powered by an electric motor. A first proximity sensor is activated by the coupling member when the pinion and shaft are located in the first position and a second proximity sensor is activated by the coupling member when the pinion and shaft are located in the second position. When either the first or second proximity sensor is activated, the electric motor and hydraulic pump are deactivated. A timer is provided to deactivate the motor and hydraulic pump if neither of the first or second proximity sensors are activated within a predetermined time period.

BRIEF DESCRIPTION OF THE DRAWING FIGURES

DETAILED DESCRIPTION OF THE PREFERRED EMBODIMENT

Figure 2:
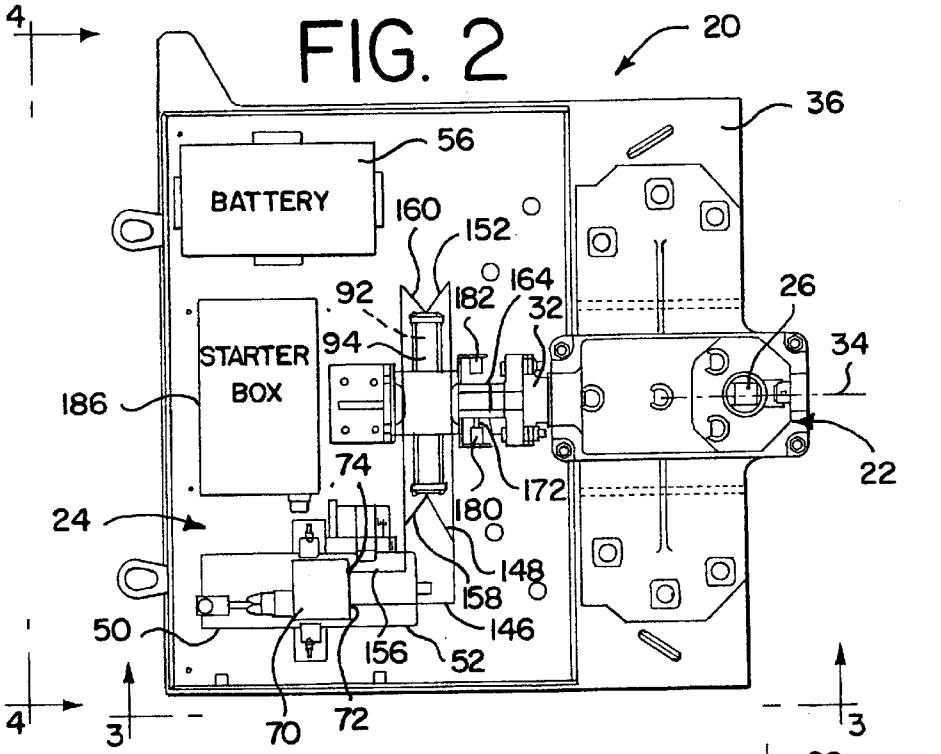
FIG. 2 is a top plan view of the switch stand and operator assembly of the switch machine.
Figure 3:
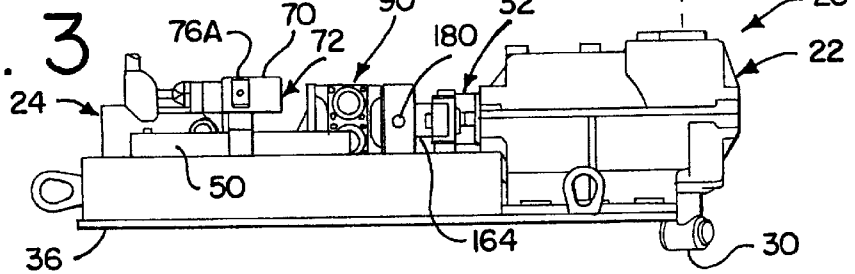
FIG. 3 is a side elevational view taken along line 3—3 of FIG. 2.
Figure 1:
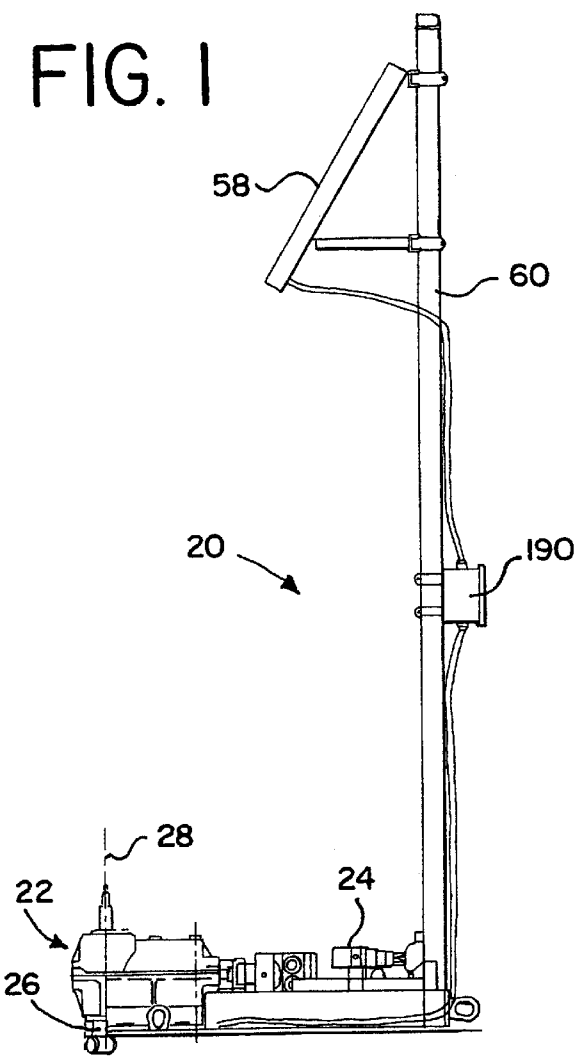
FIG. 1 is a side elevational view of the switch machine of the present invention.
Figure 4:
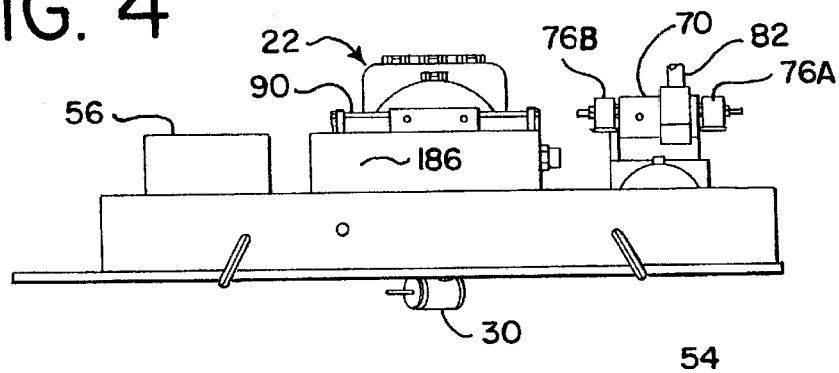
FIG. 4 is a front elevational view taken along line 4—4 of FIG. 2.
Figure 5:
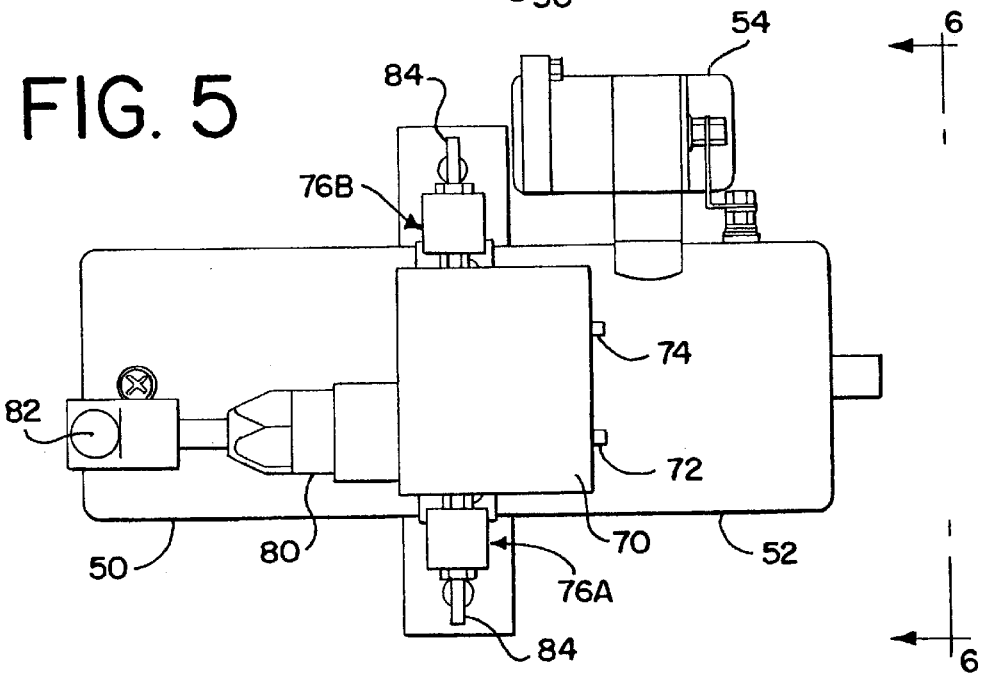
FIG. 5 is a top plan view of the electric motor and hydraulic pump assembly of the operator assembly.
Figure 6:
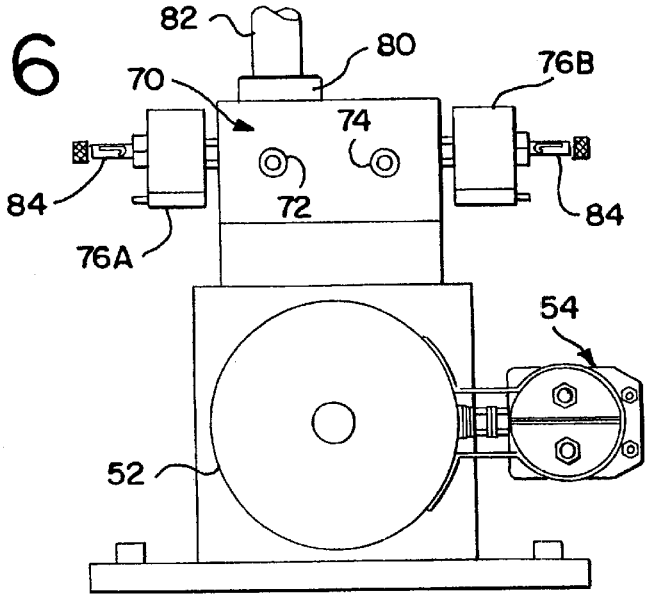
FIG. 6 is a front elevational view taken along line 6—6 of FIG. 5.

The switch machine 20 of the present invention includes a switch stand 22 and an operator assembly 24. The switch stand 22 is preferably constructed as shown in U.S. Pat. No. 2,054,543 or U.S. Pat. No. 2,575,037, which are incorporated herein by reference. The switch stand 22 includes a pivot shaft or spindle 26 that is selectively rotatable about a generally vertical axis 28. A threaded socket 30 is attached to the bottom end of the spindle 26. The socket 30 is adapted to be attached to a connecting rod (not shown) by a crank arm (not shown). The connecting rod is attached to a first switch point and a second switch point of a conventional railroad switch. The spindle 26 is operatively connected to a hub 32 that is selectively rotatable about a generally horizontal axis 34. The hub 32 is selectively rotatable about the axis 34 through an angle of approximately 180° between a first position and a second position. When the hub 32 is rotated in a first rotational direction from its first position to its second position, the hub 32 correspondingly rotates the spindle 26 and socket 30 about the axis 28 and moves the connecting rod in a generally linear direction to thereby move the switch points from their respective first positions to their respective second positions. Similarly, when the hub 32 is rotated in a second rotational direction, opposite to the first rotational direction, from the second position to the first position, the spindle 26 and socket 30 is rotated in an opposite direction and the switch points are moved from their respective second positions to their respective first positions. The switch stand 22 is preferably constructed as shown in U.S. Pat. No. 2,054,543 or U.S. Pat. No. 2,575,037, other than that the hand lever, which is used for manual operation, is removed. The switch stand 22 is attached to a base plate 36.

The operator assembly 24 includes a selectively openable cover (not shown) that encloses the operator assembly 24. The operator assembly 24 includes an electrically operated direct current (DC) motor 50. The motor 50 is operatively connected to a hydraulic pump 52 such that the hydraulic pump 52 is powered by the motor 50. The hydraulic pump 52 is in fluid communication with a reservoir of hydraulic fluid. A starter solenoid 54 is in electrical communication with the motor 50. A twelve volt DC battery 56 is in electrical communication with the starter solenoid 54 and the motor 50. A solar panel 58 is attached to and supported by a mast 60. The solar panel 58 is in electrical communication with a voltage regulator 62 and thereby the battery 56. The solar panel 58 provides electrical power to the battery 56 to maintain the battery 56 in a charged condition. Alternatively, one-hundred twenty volt alternating current can be provided to a transformer (not shown) in the operator assembly 24 which transforms the one-hundred twenty volt alternating current to twelve volt direct current. The resulting direct current can be used to directly power the motor 50 and can be used to maintain the battery 56 in a charged condition in case of a power failure.

The operator assembly 24 includes a valve 70 having a first port 72 and a second port 74. The valve 70 is in fluid communication with the hydraulic pump 52. The valve 70 is operated by a first solenoid 76A and a second solenoid 76B. The solenoids 76A and B are electrically actuated to either allow the pumping of hydraulic fluid from the pump 52 out of the first port 72 and for return through the second port 74, or for the pumping of the hydraulic fluid out of the second port 74 for return through the first port 72, as desired.

A manually operated hydraulic pump 80 is in fluid communication with the valve 70 and the reservoir of hydraulic fluid. A handle 82 is selectively attachable to the manual pump 80 to provide for the manual pumping of hydraulic fluid from the valve 70. Each solenoid 76A and B includes a selector switch 84 which may be manually switched between automatic operation and manual operation. Activation of the selector switches 84 allows manual operation of the manual pump 80 to selectively pump hydraulic fluid through either the first port 72 or the second port 74 as desired. Switching of the selector switches 84 back to the automatic mode of operation permits the hydraulic pump 52 to pump hydraulic fluid through either the first port 72 or second port 74 as desired.

Figure 7:
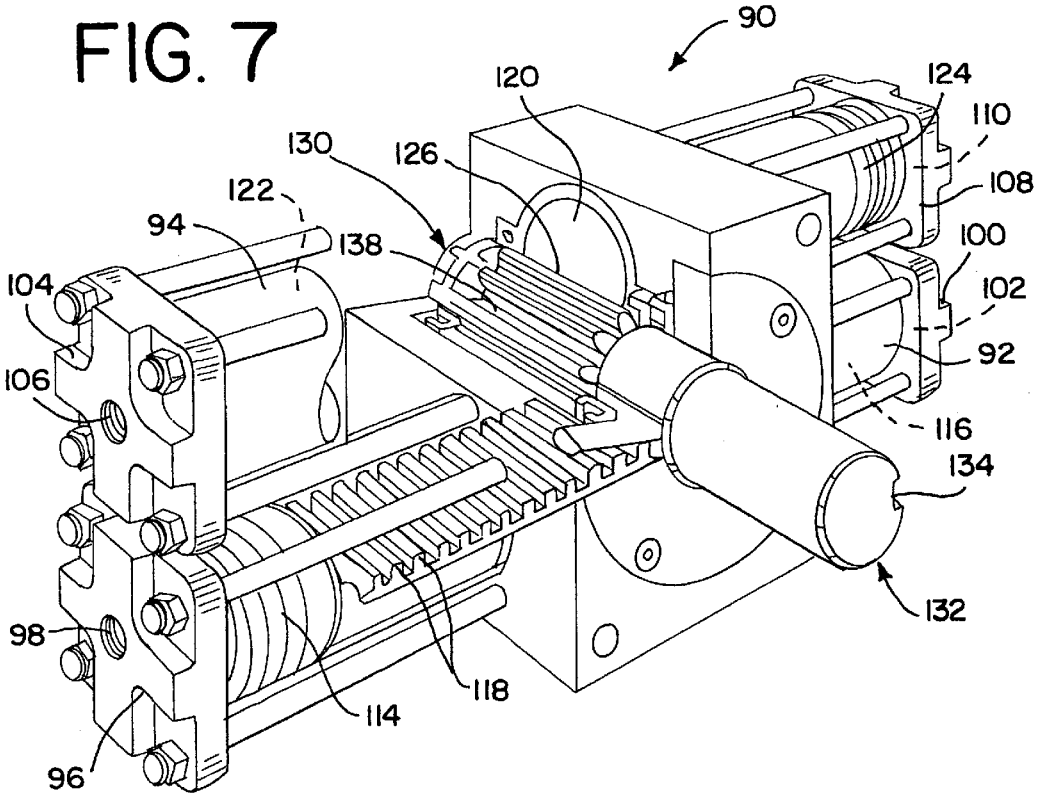
FIG. 7 is a cut-away perspective view of the rotary actuator of the operator assembly.

The operator assembly 24 also includes a hydraulic rotary actuator 90 as shown in FIG. 7. The rotary actuator 90 includes a generally cylindrical lower tube 92 and a parallel generally cylindrical upper tube 94. The lower tube 92 includes a first end 96 having a port 98 and second end 100 having a port 102. The upper tube 94 includes a first end 104 having a port 106 and a second end 108 having a port 110. A generally linearly extending lower rack 112 is located within the lower tube 92. A first piston 114 is attached to a first end of the lower rack 112 and a second piston 116 is attached to a second end of the lower rack 112. The rack 112 includes a plurality of teeth 118 that are located between the first and second ends of the lower rack 112 and that are generally parallel to one another. The teeth 118 extend generally linearly in a direction generally transverse to the longitudinal axis of the lower rack 112. The teeth 118 are located on the upper side of the lower rack 112. The first piston 114 is adapted to form a generally fluid-tight chamber within the lower tube 92 at the first end 96 which is in fluid communication with the port 98. The second piston 116 is adapted to form a generally fluid-tight chamber within the lower tube 92 at the second end 100 which is in fluid communication with the port 102.

An elongate generally linearly extending upper rack 120 is disposed within the upper tube 94. The upper rack 120 includes a first piston 122 attached to a first end of the upper rack 120 and a second piston 124 attached to a second end of the upper rack 120. The upper rack 120 includes a plurality of teeth 126 on the bottom side of the rack 120. The teeth 126 are located generally parallel and adjacent to one another and extend generally transversely to the longitudinal axis of the upper rack 120 and parallel to the teeth 118 of the lower rack 112. The first piston 122 is adapted to form a generally fluid-tight chamber within the upper tube 94 at the first end 104 in fluid communication with the port 106. The second piston 124 is adapted to form a generally fluid-tight chamber within the upper tube 94 at the second end 108 in fluid communication with the port 110. The lower rack 112 and the upper rack 120 are linearly moveable in opposite directions with respect to one another along their longitudinal axes within their respective tubes 92 and 94.

The rotary actuator 90 includes a rotatable pinion 130 disposed between the lower rack 112 and the upper rack 120. The pinion 130 includes a plurality of teeth 138 disposed in a generally circular manner about the central longitudinal axis of the pinion 130. The teeth 138 are generally linear and are spaced apart and generally parallel to one another. The teeth 138 operatively engage the teeth 118 of the lower rack 112 and the teeth 126 of the upper rack 120. A generally cylindrical shaft 132 having a keyway 134 is attached at one end to the pinion 130 for conjoint rotation with the pinon 130 about the central axis of the pinion 130 and about a colinear central axis of the shaft 132. The lower rack 112 is adapted to slide linearly within the lower tube 92 in a first direction while the upper rack 120 simultaneously linearly slides within its upper tube 94 in a second and opposite direction to thereby impart rotational movement of the pinion 130 and shaft 132 about their central longitudinal axes in a first rotational direction. Similarly, when the lower rack 112 is slid in a second linear direction, the upper rack 120 is slid in a linearly opposite first direction, and the racks 112 and 120 impart rotational movement of the pinion 130 and shaft 132 about their central longitudinal axes in a second rotational direction opposite the first rotational direction. The selective linear movement of the lower rack 112 and upper rack 120 is adapted to rotate the pinion 130 and shaft 132 through an angle of approximately 180° between a first rotational position and a second rotational position. If desired the rotary actuator 90 could include only one rack.

As best shown in FIG. 2, a conduit 146 is connected in fluid communication with the first port 72 of the valve 70. A conduit 148 is connected in fluid communication with the conduit 146 and is connected in fluid communication with the port 106 at the first end 104 of the upper tube 94. A conduit 150 is attached in fluid communication with the conduit 146 and is attached in fluid communication with the port 102 at the second end 100 of the lower tube 92.

A conduit 156 is attached in fluid communication to the second port 74 of the valve 70. A conduit 158 is attached in fluid communication with the conduit 156 and is attached in fluid communication with the port 98 at the first end 96 of the lower tube 92. A conduit 160 is attached in fluid communication with the conduit 156 and is attached in fluid communication with the port 110 at the second end 108 of the upper tube 94.

Figure 8:
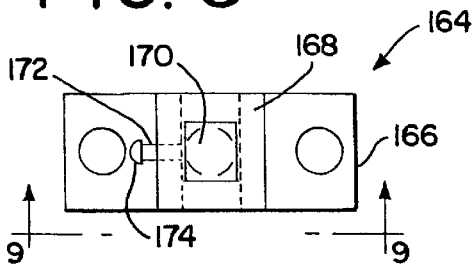
FIG. 8 is a front elevational view of a coupler member of the operator assembly.
Figure 9:
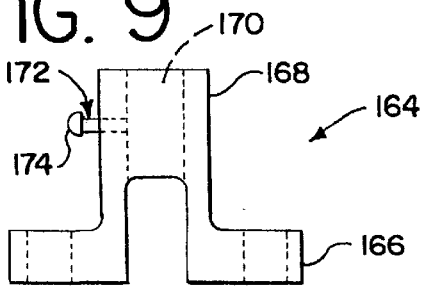
FIG. 9 is a bottom view taken along line 9—9 of FIG. 8.

The operator assembly 24 includes a coupler member 164 as best shown in FIGS. 8 and 9. The coupler 164 includes a first end 166 that is adapted to be connected to the hub 32 of the switch stand 22 by a plurality of threaded fasteners such that the coupler 164 is conjointly rotatable with the hub 32 about the axis 34. The coupler 164 includes a second end 168 that includes a bore 170 adapted to receive an end of the shaft 132. The coupler 164 is attached to the shaft 132 such that the coupler 164 is conjointly rotatable with the pinion 130 and shaft 132 about the axis 34. The bore 170 may be generally circular or rectangular. A trip member 172 having a head 174 extends generally radially outwardly from the second end 168 of the coupler member 164. The trip member 172 may be a threaded bolt, screw or the like. The coupler member 164 is adapted to couple the pinion 130 and shaft 132 of the rotary actuator 90 to the hub of a switch stand of the type as shown in U.S. Pat. No. 2,054,543.

Figure 10:
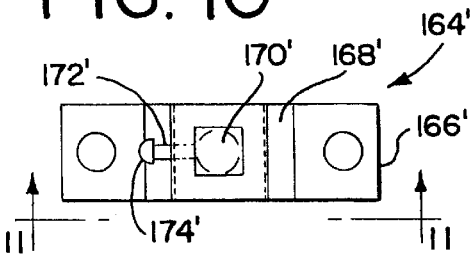
FIG. 10 is a front elevational view of an alternate embodiment of the coupler member.
Figure 11:
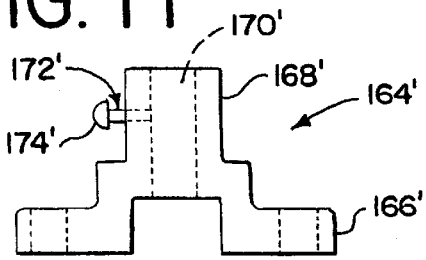
FIG. 11 is a bottom view taken along line 11—11 of FIG. 10.
Figure 12:
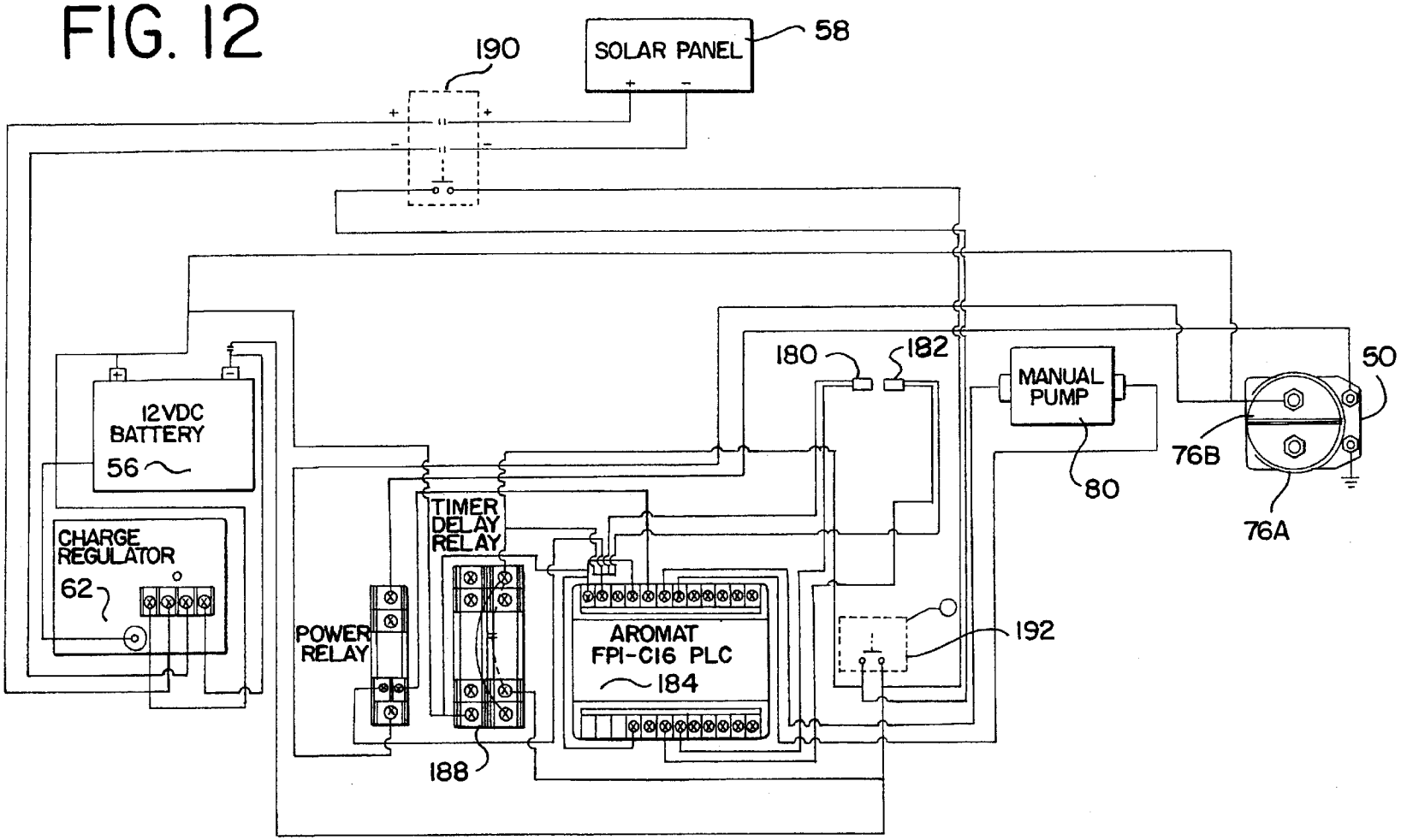
FIG. 12 is an electrical schematic of the present invention.

An alternate embodiment of the coupler member is shown in FIGS. 10 and 11 and is identified with the reference number 164'. The coupler member 164' is adapted to couple the rotary actuator 90 to a switch stand such as shown in U.S. Pat. No. 2,575,037. The coupler member 164' is constructed similar to the coupler member 164 and common features are shown in FIGS. 10 and 11 using the same reference numbers with the addition of a prime symbol.

As best shown in FIG. 2, a first proximity sensor 180 and a second proximity sensor 182 are stationarily attached to the rotary actuator 90 on opposite sides of the second end 168 of the coupler 164. When the coupler 164 is located in a first rotational position, wherein the shaft 132 is in its first position, the trip member 172 of the coupler 164 is adapted to engage and activate the first proximity sensor 180. When the coupler 164 is rotated to a second rotational position, wherein the shaft 132 is in its second position, approximately 180° from the first rotational position, the trip member 172 of the coupler 164 is adapted to engage and activate the second proximity sensor 182.

The first and second proximity sensors 180 and 182 are electrically connected to a programmable logic control 184, such as an Aromat Model FP1-C16 PLC. The logic control 184 is located within a selectively openable enclosure 186. A timer 188 is also electrically connected to the programmable logic control 184. A first switch 190 and a second switch 192 are electrically connected between the battery 56 and the motor 50. The first switch 190 is located on the mast 60 and the second switch 192 is located adjacent the motor 50. The switches 190 and 192 each include a single button. Activation of the switch 190 or 192 starts operation of the motor 50 and the pumping of hydraulic fluid by the hydraulic pump 52 to the valve 70.

When the switch points are located in their respective first positions, the coupler 164, pinion 130, shaft 132, and hub 32 are located in their first positions such that the trip member 172 is in engagement with and is activating the first proximity sensor 180. When the coupler 164 is in its first position the lower rack 112 is located within the lower tube 92 such that the second piston 116 is located adjacent the second end 100 and such that the first piston 114 is spaced apart from the first end 96 forming a chamber therebetween. The upper rack 120 is located within the upper tube 94 such that the first piston 122 is located adjacent the first end 104 and such that the second piston 124 is spaced apart from the second end 108 forming a chamber therebetween.

When the switch 190 or 192 is manually activated, the battery 56 will power the motor 50 and the motor 50 will power the hydraulic pump 52. Activation of the first proximity sensor 180 by the trip member 172 causes the solenoids 76A and B to configure the valve 70 such that hydraulic fluid pumped by the hydraulic pump 52 will flow outwardly through the first port 72 and through the conduits 146, 148 and 152. Hydraulic fluid flowing through the conduit 148 will flow through the port 106 and will cause the upper rack 120 to slide linearly toward the second end 108 of the upper tube 94. Hydraulic fluid within the chamber formed at the second end 108 of the upper tube 94 will be expelled through the port 110 into the conduit 160. At the same time, hydraulic fluid from the conduit 152 will flow through the port 102 and will linearly slide the lower rack 120 toward the first end 96 of the lower tube 92. Fluid within the chamber at the first end 96 will be expelled through the port 98 and will flow into the conduit 158. The hydraulic fluid that is expelled from the rotary actuator 90 into the conduits 158 and 160 flows through the conduit 156 and the second port 74 in the valve 70 to the reservoir of hydraulic fluid.

As the upper rack 120 slides linearly toward the second end 108 of the upper tube 94, and the lower rack 112 slides linearly toward the first end 96 of the lower tube 92, the racks 112 and 120 rotate the pinion 130 and shaft 132 in a first rotational direction about their common central longitudinal axis through an angle of approximately 180° to the second position of the pinion 130 and shaft 132. The coupler 164 rotates conjointly with the pinion 130 and shaft 132 such that the trip member 172 rotates into engagement with and activates the second proximity sensor 182. When the second proximity sensor 182 senses the trip member 172, the second proximity sensor 182 disconnects the battery 56 from the motor 50 thereby stopping the pumping of hydraulic fluid by the hydraulic pump 52. The rotation of the coupler 164 rotates the hub 32, spindle 26 and socket 30 of the switch stand 22 and thereby moves the switch points from their first position to their second position.

If an obstruction prevents the switch points from fully moving from their first position to their second position, the trip member 172 will not reach and activate the second proximity sensor 182. If the trip member 172 does not activate the second proximity sensor 182 within a preset time limit as measured by the timer 188, such as within two or three seconds after disengaging the first proximity sensor 180, the logic control 184 will activate the solenoids 76A and B and configure the valve 70 to pump hydraulic fluid through the second port 74 and the conduits 156, 158 and 160 to rotate the pinion 130, shaft 132 and coupler 164 in a second rotational direction. The coupler 164, pinion 130, shaft 132 and hub 32 are thereby returned to their first positions wherein the trip member 172 engages the first proximity sensor 180 and wherein the switch points are located in their first position. When the first proximity sensor 180 senses the trip member 172, the first proximity sensor 180 will disengage the supply of power to the motor 50 and deactivates the hydraulic pump 52. If the switch points are obstructed from returning to their original first position, as well as the second position, such that the trip member 172 will not be sensed by either the first proximity sensor 180 or the second proximity sensor 182, the timer 188 will disconnect the power source from the motor 50 and deactivate the hydraulic pump 52 after a preset time limit such as six seconds. During normal operation the timer 188 will also disconnect the power source from the motor 50 after a preset time limit, such as six seconds, to prevent power drain.

When the switch points are located in their respective second positions, the coupler 164 will be orientated such that the trip member 172 is in engagement with and activates the second proximity sensor 182. The second proximity sensor 182 activates the solenoids 76A and B to direct the flow of hydraulic fluid from the valve 70 through the second port 74 into the conduits 156, 158 and 160. Fluid thereby flows into the port 110 at the second end 108 of the upper tube 94 and the port 98 at the first end 96 of a lower tube 92. The lower rack 112 is thereby slid linearly toward the second end 100 of the lower tube 92 and the upper rack 120 is slid linearly toward the first end 104 of the upper tube 94. This movement of the lower rack 112 and upper rack 120 causes the pinion 130 and shaft 132 to rotate in a second rotational direction opposite to the first rotational direction, such that the coupler 164 is rotated approximately 180° until the trip member 172 engages the first proximity sensor 180 which then disconnects the power source to the motor 50. Rotation of the pinion 130, shaft 132 and coupler 164 to their first position, such that the trip member 172 is sensed by the first proximity sensor 180, causes the hub 32, spindle 26 and socket 30 to rotate and thereby move the switch points from the second position to the first position. If an obstruction is encountered that prevents movement of the switch points to the first position, after the trip member 172 has deactivated the second proximity sensor 182 and has not activated the first proximity sensor 180 for the preset time period, the timer 188 and the controller 184 will return the switch points to the second position.

The operator assembly 24 may be retrofit to various types of previously installed switch stands, by removal of the manual hand lever from the switch stand, and by connecting the pinion 130, shaft 132 and coupler 164 to the hub 32 of the previously installed switch stand. Thus a previously installed manually operated switch stand can be simply converted into an automatic electrically operated switch stand.

Various features of the invention have been particularly shown and described in connection with the illustrated embodiment of the invention, however, it must be understood that these particular arrangements merely illustrate and that the invention must be given the fullest interpretation within the terms of the appended claims.

What is claimed is:

1. An operating apparatus for operating a railroad switch stand having a rotatable hub, said operating apparatus including:

a rotary actuator having a rotatable shaft, said shaft being selectively rotatable between a first position and a second position;

a coupling member having a first and a second end, said second end of said coupling member attached to said shaft of said rotary actuator such that said coupling member is adapted to conjointly rotate with said shaft, said first end of said coupling member adapted to be attached to the hub of the switch stand such that said coupling member is adapted to conjointly rotate with the hub of the switch stand, said coupling member adapted to rotationally couple said shaft to the hub of the switch stand and to provide conjoint rotation of the hub of the switch stand with said shaft of said rotary actuator;

a hydraulic pump in fluid communication with said rotary actuator for providing selective rotational movement of said shaft; and a first sensor adapted to be activated when said shaft is located in said first position;

whereby when said first sensor is activated said first sensor deactivates said hydraulic pump.

2. The operating apparatus of claim 1 including a second sensor adapted to be activated when said shaft is located in said second position, said second sensor adapted to deactivate said hydraulic pump when said second sensor is activated.

3. The operating apparatus of claim 2 wherein said coupling member includes a trip member adapted to activate said first sensor when said shaft is located in said first position and to activate said second sensor when said shaft is located in said second position.

4. The operating apparatus of claim 2 wherein said first sensor and said second sensor respectively comprise proximity sensors.

5. The operating apparatus of claim 2 including a timer for timing when said first sensor is activated and when said second sensor is activated.

* * * * *